US006131678A

United States Patent [19]

Griffin

[11] Patent Number: 6,131,678

[45] Date of Patent: Oct. 17, 2000

[54] PREFORM ELEMENTS AND MOUNTINGS THEREFOR

[75] Inventor: Nigel Dennis Griffin, Whitminster, United Kingdom

[73] Assignee: Camco International (UK) Limited, Stonehouse, United Kingdom

[21] Appl. No.: 09/061,615

[22] Filed: Apr. 16, 1998

[30] Foreign Application Priority Data

Feb. 14, 1998 [GB] United Kingdom ..... 9803096

[51] Int. Cl.[7] ..... E21B 10/36

[52] U.S. Cl. ..... 175/434; 175/426; 175/428; 175/430

[58] Field of Search ..... 175/426, 428, 175/430, 432, 434

[56] References Cited

U.S. PATENT DOCUMENTS

| | | | |
|---|---|---|---|
| 4,109,737 | 8/1978 | Bovenkerk | 175/430 |
| 4,333,540 | 6/1982 | Daniels et al. . | |
| 4,440,246 | 4/1984 | Jurgens . | |
| 4,570,726 | 2/1986 | Hall . | |
| 4,718,505 | 1/1988 | Fuller | 175/428 |
| 5,279,375 | 1/1994 | Tibbitts et al. | 175/428 |
| 5,335,738 | 8/1994 | Waldenstrom et al. | 175/426 X |
| 5,351,770 | 10/1994 | Cawthorne et al. | 175/426 X |
| 5,379,853 | 1/1995 | Lockwood et al. . | |
| 5,379,854 | 1/1995 | Dennis | 175/434 |
| 5,499,688 | 3/1996 | Dennis | 175/426 |
| 5,533,582 | 7/1996 | Tibbitts | 175/430 |
| 5,544,714 | 8/1996 | Dennis | 175/426 X |
| 5,590,728 | 1/1997 | Matthias et al. | 175/434 X |
| 5,605,199 | 2/1997 | Newton | 175/432 |
| 5,630,479 | 5/1997 | Dennis . | |
| 5,722,497 | 3/1998 | Gum et al. | 175/426 X |
| 5,862,873 | 1/1999 | Matthias et al. | 175/432 |
| 5,871,060 | 2/1999 | Jensen et al. | 175/434 X |
| 6,000,483 | 12/1999 | Jurewicz et al. | 175/428 |

*Primary Examiner*—Eileen D Lillis
*Assistant Examiner*—Jong-Suk Lee
*Attorney, Agent, or Firm*—Jeffery E. Daly

[57] ABSTRACT

A preform element comprises a substrate having an outer peripheral surface and at least one end surface. At least a portion of the peripheral surface of the substrate has bonded thereto an inner surface of a peripherally extending facing layer of superhard material, such as polycrystalline diamond. The portion of the peripheral surface of the substrate and the inner surface of the peripheral facing layer are provided with inter-engaging formations, such as ribs and grooves, whereby the peripheral facing layer is keyed to the substrate.

11 Claims, 5 Drawing Sheets

PREFORM ELEMENTS AND MOUNTINGS THEREFOR

BACKGROUND OF THE INVENTION

1. Field of Invention

The invention relates to preform elements faced with superhard material, and particularly to preform cutting elements, for use in drag-type rotary drill bits, comprising a facing layer of superhard material bonded to a substrate of material which is less hard than the superhard material.

2. Description of Related Art

Preform elements of this kind are often used as cutting elements on rotary drag-type drill bits, and the present invention will be particularly described in relation to such use. However, the invention is not restricted to cutting elements for this particular use, and may relate to preform cutting elements for other purposes. For example, elements faced with superhard material of the kind referred to may also be employed in workpiece-shaping tools.

Preform elements used as cutting elements in rotary drill bits are generally in the form of circular or part-circular tablets comprising a flat facing table of superhard material, the rear surface of which is bonded, in a high pressure high temperature press, to the front surface of a less hard substrate. The front facing table is usually of polycrystalline diamond, although other superhard materials are available, such as cubic boron nitride and amorphous diamond-like carbon (ADLC). The substrate is often formed from cemented tungsten carbide.

In order to mount the cutting element on the body of a drill bit, the rear surface of the substrate of the element is often bonded, for example by brazing, to a carrier in the form of a stud or post, often of cemented tungsten carbide. Part of the carrier is then received in a socket in the bit body, and secured by brazing or shrink-fitting, so as to hold the cutting element at the appropriate orientation to the bit body and hence to the surface of the formation being drilled. Usually the cutting element is orientated so that part of the outer periphery of the facing table forms a cutting edge which engages the formation, so that during use a wear flat develops extending at an angle across the facing table and substrate, and perhaps also part of the carrier.

In an alternative arrangement the substrate is of sufficient axial length that it may, itself, be secured within a socket in the bit body.

Other forms of cutting element are known where the superhard facing layer is applied around the peripheral surface of a generally cylindrical, as shown for example in U.S. Pat. No. 5,279,375.

In this type of cutting element a cylindrical part of the element, which may or may not include part of the peripheral superhard facing layer, is secured within a socket in the bit body. During use of the cutting element the cutting face of the element comprises an area of substrate, exposed at one end of the element and surrounded by an annular surface of superhard material, comprising the end edge of the peripheral superhard layer. Arrangements are also known where the exposed part of the cutting element is frusto-conical so as to reduce the area of the element which forms the cutting face.

The present invention relates to certain improvements in preform cutting elements of the last-mentioned kind and to methods of mounting such elements, as well as other types of preform elements on the body of the drill bit.

SUMMARY OF THE INVENTION

According to the invention there is provided a preform element comprising a substrate having an outer peripheral surface and at least one end surface, at least a portion of the peripheral surface of the substrate having bonded thereto an inner surface of a peripherally extending facing layer of superhard material, said portion of the peripheral surface of the substrate and the inner surface of the peripheral facing layer being provided with inter-engaging formations whereby the peripheral facing layer is keyed to the substrate.

The inter-engaging formations may include inwardly extending projections on the inner surface of the facing layer which engage within corresponding recesses in the portion of the outer surface of the substrate, and/or outwardly extending projections on said portion of the outer surface of the substrate which engage within corresponding recesses in the inner surface of the facing layer.

Said inter-engaging projections and recesses may be of any suitable shape. For example, said projections and recesses may comprise inter-engaging elongate ribs and grooves. Said ribs and grooves may extend circumferentially of the element, or generally axially of the element, or in an orientation inclined to the axis of the element. Said ribs and grooves may be generally parallel.

Said peripheral superhard facing layer may extend to a peripheral junction between said portion of the peripheral surface of the substrate and the said end surface of the substrate. In this case the superhard facing layer may have an integral end portion which extends partly or completely across said end surface of the substrate. The end surface of the substrate and the end portion of the facing layer may then also be provided with inter-engaging formations to provide a key between them.

In the case where a portion of the facing layer does not extend across the end surface of the substrate, elements of superhard material may be embedded in the exposed end surface of the substrate. For example, said elements of superhard material may comprise natural diamonds, or bodies of synthetic polycrystalline diamond.

The facing layer may extend only partly around said portion of the peripheral surface of the substrate. For example, said portion of the peripheral surface of the substrate may comprise a curved surface part and one or more substantially flat surface parts, the facing table being bonded only around the curved surface part of the substrate.

In this case a plurality of preform elements may be manufactured by bonding a facing layer of superhard material around the whole of the outer peripheral surface of a cylindrical substrate, to form an intermediate element, and then cutting the intermediate element into two or more sections.

As previously mentioned, the present invention also provides a novel form of mounting assembly for securing a cutter to the body of a drill bit. This aspect of the invention is particularly applicable to cutters comprising or incorporating preform cutting elements according to the first aspect of the invention, but may also be employed for mounting on a bit body cutters incorporating other types of cutting element.

According to this aspect of the invention there is provided a mounting assembly for mounting a preform cutter on the body of a drill bit, the assembly comprising a mounting part on the cutter having a locking portion which is of increased lateral extent adjacent an end surface of the mounting part, said locking portion being located beneath a retaining surface on the bit body, and detent means being secured to the bit body in a manner to prevent displacement of said locking portion from its location beneath the retaining surface.

The retaining surface may comprise a surface of an undercut recess integrally formed in the bit body to receive said locking portion of the cutter mounting part. In this case the detent means may comprise an element secured to the bit body in a location to abut the mounting part of the cutter and thereby hold the locking portion thereof within said recess.

Alternatively, the retaining surface may comprise a surface on a clamping element which overlies said locking portion of the cutter mounting part, said detent means securing the clamping element to the bit body.

Said locking portion of increased lateral extent may comprise a laterally extending flange formed on the cutter mounting part adjacent the end surface thereof. In the case where the cutter mounting part is generally cylindrical the flange may be an annular peripheral flange extending around said mounting part.

Alternatively, said locking may comprise a surface of the cutter mounting part which is inclined so as to increase in lateral extent as it extends towards the end surface of the mounting part. For example, an outer surface of said locking part may extend at an acute angle to the end surface of the mounting part. Two such locking portions may extend from opposite sides of the cutter mounting part to provide a dovetail configuration. In the case where the cutter mounting part is generally cylindrical, the locking portion may be generally frusto-conical in shape.

In any of the above arrangements the detent means may comprise a screw in screw-threaded engagement with the bit body and having an enlarged head shaped to engage the cutter mounting part, or an element abutting said part.

The above mounting assemblies are particularly suitable for mounting cutters comprising a substrate integral with, or secured to, said mounting part and having an outer peripheral surface at least a portion of which has bonded to a peripherally extending facing layer of superhard material.

In an alternative mounting assembly according to the invention, for mounting a cutter of the last-mentioned kind, the cutter is formed with a stepped hole extending through the interior of the substrate from one end face to an opposite end face thereof, said hole receiving a securing screw which threadedly engages a threaded hole in the bit body, the screw having an enlarged head part of which overlies a surface of the cutter so that the screw clamps the cutter to the bit body.

Preferably a mounting part of the cutter, adjacent said opposite end face thereof, is received a socket in the bit body.

In any of the above mounting assemblies, the mounting part is preferably a body of rotation so that the cutter may be rotatably indexed to any one of a number of alternative rotational orientations on the bit body before being secured to the bit body.

In any of the forms of cutting element referred to above, a transition layer may be located between the inner surface of the peripheral superhard facing layer and the peripheral surface of the 10 substrate, said transition layer having at least one property the characteristics of which are intermediate the characteristics of the same property of the superhard material and the material of the substrate respectively. For example, the coefficient of thermal expansion of the transition layer is preferably intermediate the coefficient of thermal expansion of the superhard facing layer and the substrate respectively.

DETAILED DESCRIPTION OF THE PREFERRED EMBODIMENTS

Figure 1:
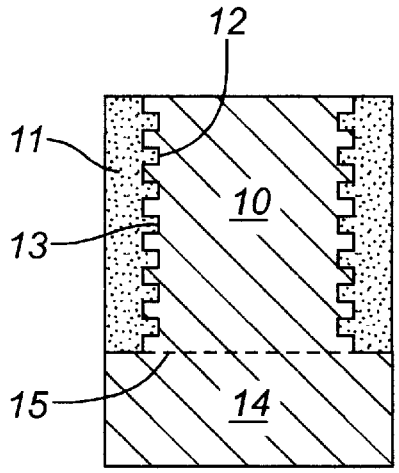
FIGS. 1–5 are diagrammatic longitudinal sections through preform cutting elements in accordance with the invention.

Referring to FIG. 1: one form of preform cutting element in accordance with the present invention comprises a cylindrical substrate 10 of circular cross-section formed from cemented tungsten carbide. Bonded to the outer periphery of the substrate 10 is a peripheral facing layer 11 of polycrystalline diamond of constant thickness. The outer surface of the substrate 10 is formed with a plurality of axially spaced peripheral annular grooves 12 of rectangular cross-section into which extend corresponding annular projections 13 integral with the diamond layer 11. The inter-engaging ribs 13 and grooves 12 serve to key the diamond layer 11 to the substrate 10.

Beyond the lower end of the diamond layer 11 the substrate 10 is integrally formed with a cylindrical mounting part 14 which is of the same external diameter as the diamond layer 11 so that the cutting element, overall, is cylindrical.

The preform cutting element is manufactured in a high pressure, high temperature press using well known methods. The substrate 10, including the mounting part 14, is initially machined from tungsten carbide, or is moulded from tungsten carbide using a powder metallurgy process. The substrate is initially formed with the peripheral grooves 12. Polycrystalline diamond particles, with an appropriate catalyst, are then packed around the smaller diameter grooved portion of the substrate to form the diamond layer and the whole assembly is then subjected to extremely high pressure and temperature in a press. As is well known, this causes the diamond particles to bond together, with diamond-to-diamond bonding, to form the diamond layer, and at the same time the diamond layer is bonded to the substrate 10.

Instead of the mounting part 14 being integral with the substrate 10, it may comprise a separately formed cylinder of the same material as the substrate, or of another material, which is brazed or otherwise bonded to the substrate 10 as indicated by the dotted line 15.

Figure 2:
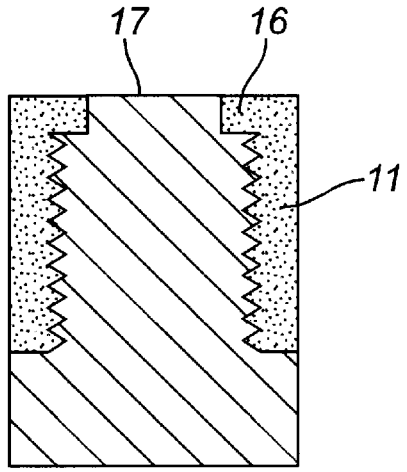

FIG. 2 shows a modified arrangement of the cutting element of FIG. 1 where the diamond layer 11 has at its upper end an inwardly projecting annular flange 16 which extends inwardly partly across the end surface 17 of the substrate 10. In an alternative arrangement (not shown) the diamond layer 11 may extend across the whole of the end face 17.

Figure 3:
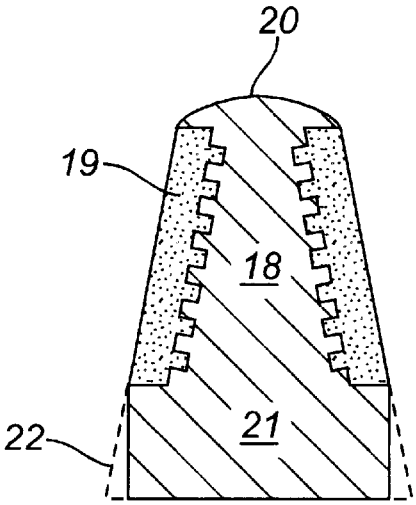

FIG. 3 shows a modified arrangement where the part of the substrate 18 to which the peripheral diamond layer 19 is bonded is frusto-conical so as to reduce the area of the end face 20 of the substrate which, in this embodiment, is domed.

In the arrangement of FIG. 3 the mounting part 21 of the cutting element is cylindrical but the mounting part may instead be part conical, as indicated in dotted lines at 22, so that the cutting element as a whole is frusto-conical. Such arrangement enables the cutting element to be mounted on a drill bit by various forms of mounting assembly, as will be described.

Figure 4:
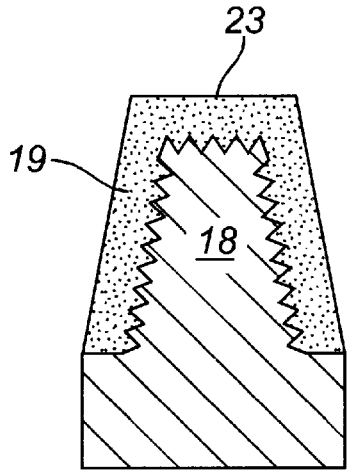

FIG. 4 shows a modification of the arrangement of FIG. 3 where the upper end surface of the substrate is generally flat and the diamond layer 19 extends across the upper end surface, as indicated at 23. Interengaging ribs and grooves, which may for example be circular and concentric, are provided between the upper diamond layer 23 and the upper end surface of the substrate.

Figure 5:
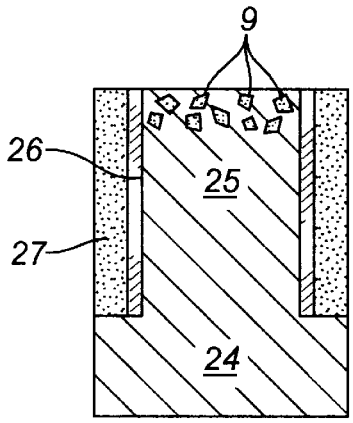
Figure 6:
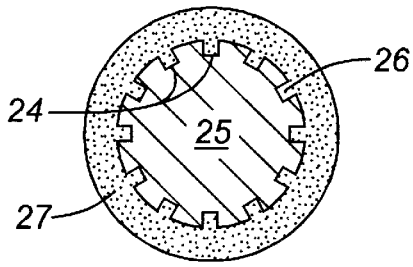
FIG. 6 is a cross-section on the Line 6—6 of FIG. 5.

FIGS. 5 and 6 show a modified version of the arrangement of FIG. 1 where the grooves 24 in the substrate 25 extend longitudinally of the substrate instead of peripherally. Again, inwardly projecting longitudinal ribs 26 on the inner surface of the diamond layer 27 extend into the grooves 24 in the substrate. In the case where a portion of the facing layer does not extend across the end surface of the substrate, elements of superhard material 9 may be embedded in the exposed end surface of the substrate. For example, the elements of superhard material may comprise natural diamonds, or bodies of synthetic polycrystalline diamond.

The arrangements shown in FIGS. 1–6 of projections and recesses at the interface between the peripheral diamond layer and the substrate are by way of example only, and it will be appreciated that the invention includes within its scope any arrangement of inter-engaging projections and recesses which serve to key the diamond layer to the substrate. The provision of such a mechanical interlock between the diamond layer and substrate enhances the bonding of the diamond layer to the substrate so that there is less risk of the diamond layer spalling or delaminating from the substrate when the cutting element is in use.

Figure 7:
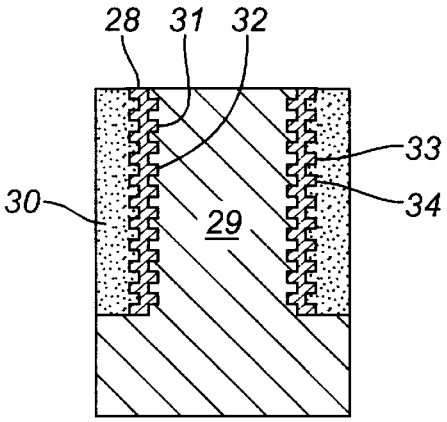
FIG. 7 is a longitudinal cross-section through another form of cutting element.

In order to further enhance the bond between the diamond facing layer and the substrate, there is preferably provided a transition layer between the diamond layer and substrate, and such an arrangement is shown diagrammatically in FIG. 7.

In this case the transition layer 28 between the substrate 29 and outer peripheral diamond layer 30 has an inner surface configured with peripheral ribs 31 which are received in peripheral grooves 32 in the substrate 29. Similarly, the outer surface of the transition layer is formed with peripheral ribs 33 which are received in peripheral grooves 34 in the diamond layer.

In bonding a polycrystalline diamond layer to a tungsten carbide substrate, problems can arise as a result of the difference in coefficient of thermal expansion between the two materials. Accordingly, the transition layer 28 is preferably formed from a material having a coefficient of thermal expansion intermediate the coefficients of polycrystalline diamond and tungsten carbide respectively.

Instead of the transition layer 28 being of sufficient thickness that it may have separate configured surfaces inter-engaging with the substrate and diamond layer respectively, the transition layer may be a thin layer of substantially constant thickness which is disposed between the interengaging projections and recesses on the diamond layer and substrate and follows the contours of such projections.

Figure 8:
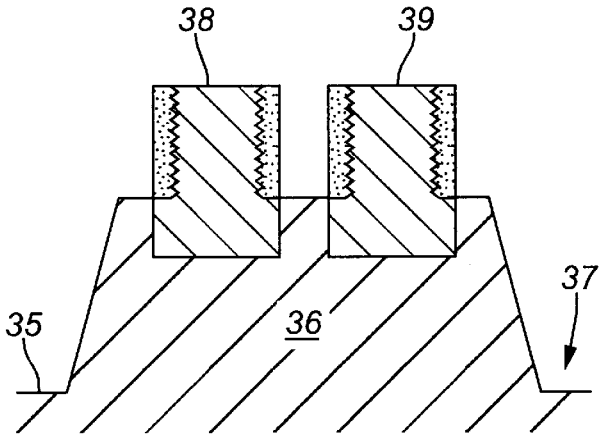
FIG. 8 is a section through a blade of a drag-type drill bit incorporating cutting elements in accordance with the invention.
Figure 9:
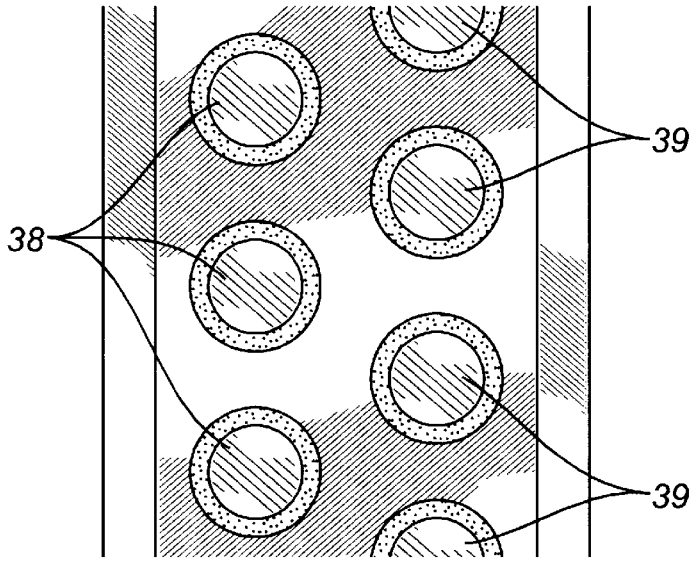
FIG. 9 is a plan view of part of the blade of FIG. 8.

FIGS. 8 and 9 show one way in which preform cutting elements according to the present invention may be used on a rotary drag-type drill bit.

As is well known, the bit body 35 may be formed with a number of upstanding blades 36 extending outwardly away from the central axis of the bit body so as to form outwardly extending channels 37 between the blades. Nozzles in the bit body deliver drilling fluid under pressure to the surface of the bit so as to flow along the blades so as to clean and cool the cutters and to remove cuttings of formation and deliver them to the surface.

In the present case, there is mounted along the leading side of the blade 36 a row of primary cutters 38 according to the invention. On the rearward side of the blade 36, with respect to the normal direction of the blade during drilling, is mounted a row of secondary cutters 39, each secondary cutter being arranged in a position generally intermediate a pair of adjacent primary cutters.

In the arrangement shown each cutter is arranged with its central longitudinal axis extending at right angles to the surface of the blade. However, arrangements are possible where the axis of each cutter is inclined forwardly or rearwardly with respect to the direction of movement. The cutters may also be provided with side rake, that is to say they may be inclined towards or away from the outer periphery of the drill bit.

Figure 10:
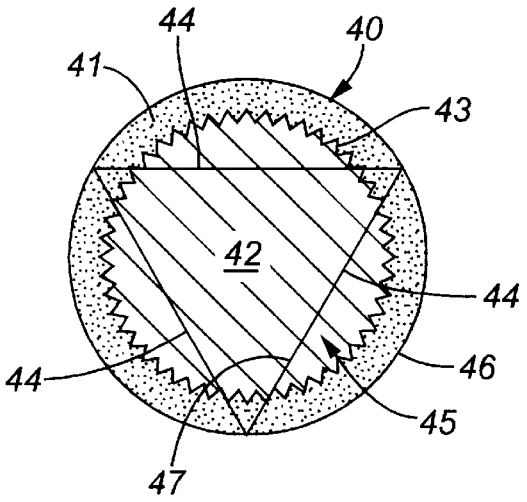
FIG. 10 shows diagrammatically how a number of cutting elements according to the invention may be formed from a single intermediate element.

FIGS. 1–9 show cutters which are generally cylindrical or frusto-conical in overall configuration. However, it is not necessary for the cutters to be of such symmetrical cross-section and FIGS. 10 and 11 show another form of cutter in accordance with the present invention.

In this case a cylindrical intermediate element 40 is first formed by the method described above in relation to FIGS. 1–6 and comprises a peripheral outer layer 41 of polycrystalline diamond or other superhard material bonded to the outer surface of a cylindrical substrate 42, a configured interface 43 being provided between the diamond layer and substrate.

After manufacture, the intermediate element 40 is cut along the lines 44 to form three similar segment-shaped cutting elements 45 each having a part cylindrical front surface 46 formed by part of the diamond layer and a flat rear surface 47 formed by part of the substrate.

Figure 11:
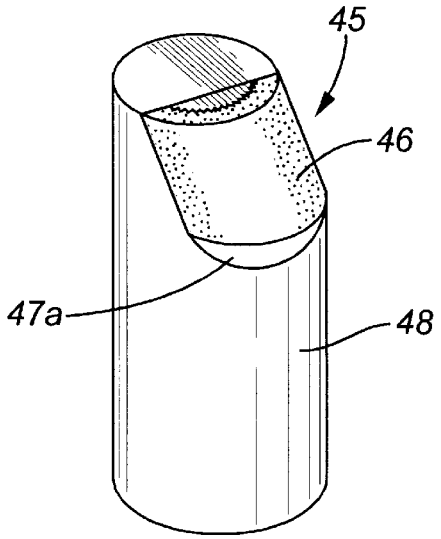
FIG. 11 is a perspective view of a cutter incorporating one of the elements of FIG. 10.

In use, each of the cutting elements 45 made by this method may be mounted, for example brazed, on to a flat inclined surface 47*a* on a tungsten carbide carrier 48 as shown in FIG. 11.

It will be appreciated that cutting elements of many different shapes may be formed by cutting them from an appropriately shaped intermediate member.

The bit body, as is well known, may be machined from solid metal, such as steel, or may be moulded from solid infiltrated matrix material using well known powder metallurgy methods.

Cutting elements according to the present invention may be mounted on a drill bit body by any of the methods commonly used in this art. For example, the cylindrical mounting part of the cutter may be received in a correspondingly-shaped socket in the bit body and secured within the socket by brazing or shrink-fitting. However, cutters in accordance with the present invention lend themselves to other forms of mounting, and FIGS. 12–16 show, by way of example, alternative forms of mounting whereby the cutter may be secured to the body of a drill bit.

Figure 12:
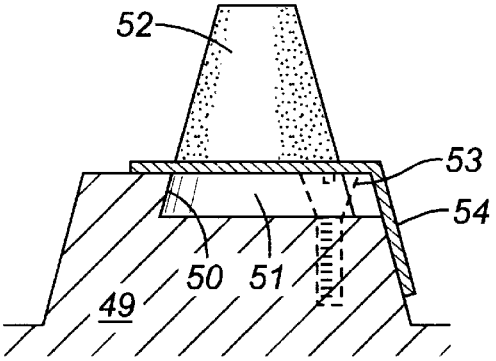
FIG. 12 is a section through a blade on a drill bit showing one form of mounting assembly for a cutter according to the invention.
Figure 13:
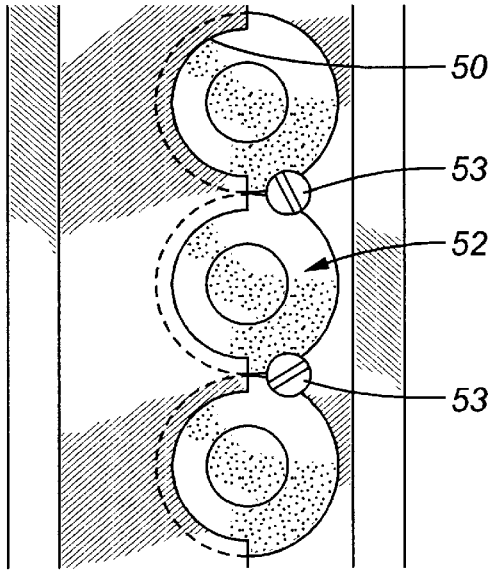
FIG. 13 is a plan view of part of the blade and mounting of FIG. 12.

FIGS. 12 and 13 show one method of mounting cutters which are generally frusto-conical in shape, for example cutters of the kind described with reference to FIG. 3. In this case the upper surface of a blade 49 on the bit body is formed with a plurality of adjacent undercut recesses 50 of generally semi-circular form. As may be seen from the drawings the angle of inclination of the undercut is such as to mate with part of the frusto-conical surface of the lower mounting part 51 of a frusto-conical cutter 52.

In order to retain each cutter 52 in engagement with its associated undercut recess, a screw 53 engages a threaded hole in the blade 49 between each adjacent pair of cutters. The underside of the head of the screw 53 is frusto-conical and of an angle so as to bear against the outer surface of the mounting part 51 of each cutter. The screws 53 thus serve to hold the cutters 52 in their corresponding recesses and thus secure the cutters to the blade.

A protective plate, indicated diagrammatically at 54 in FIG. 12 may be bonded or otherwise secured to the leading side of the blade 49 and has an upper part which encircles the cutters 52 and overlies the heads of the screws 53.

Figure 14:
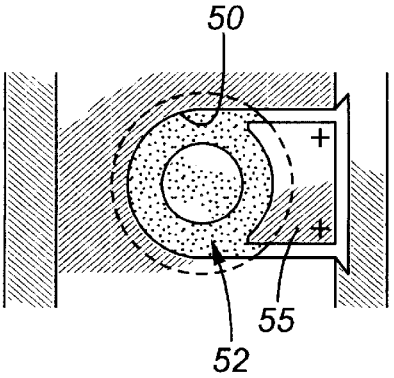
FIG. 14 is a plan view of a drill blade showing an alternative mounting assembly.

Instead of the cutters 52 being held in their shaped recesses in the blade 49 by screws 53, each cutting element may be individually held in its recess by a separate clamping member as indicated at 55 in FIG. 14. The clamping member 55 may be secured to the blade by screws or by any other method.

Figure 15:
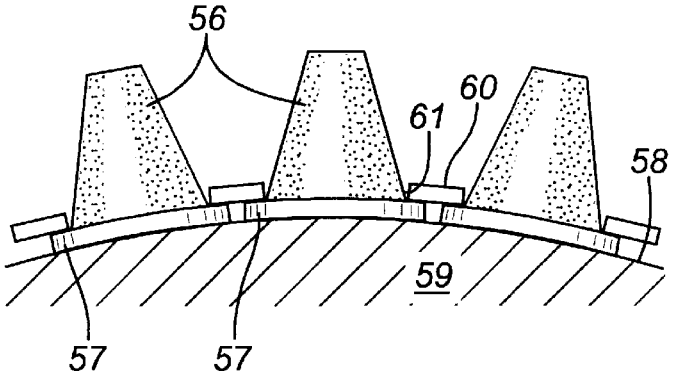
FIG. 15 is a diagrammatic section through cutters mounted on a bit blade by another form of mounting assembly.

In the arrangement of FIGS. 12–14 laterally extending portions of the cutting elements are located beneath an upper part of an undercut recess formed in the bit body itself. However, the cutters may be located by separate elements which are secured to the bit body, and one such arrangement is shown in FIG. 15.

In this arrangement each cutter 56 is generally frusto-conical in shape and is provided at its larger end with an outwardly projecting peripheral flange 57 which rests on the surface 58 of the blade 59 on the bit body. A clamping plate 60 formed with circular apertures 61 extends along the length of the blade 59 and fits over the cutters 56 so as to rest on the flanges 57. The clamping strip 60, which may be formed of any suitable material, is secured to the surface of the blade 59 by screws, brazing or any other suitable method.

Figure 16:
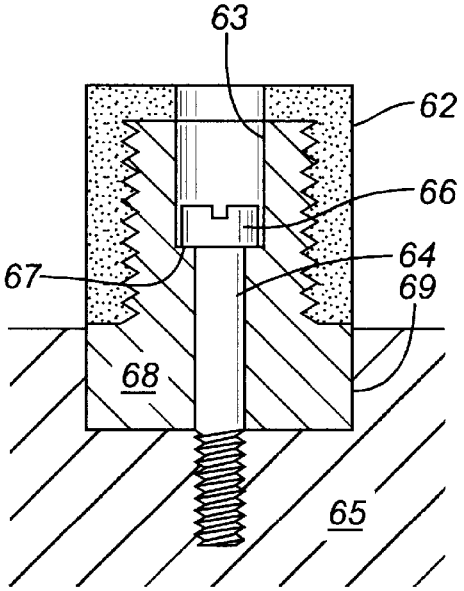
FIGS. 16 and 17 are longitudinal sections through cutting elements according to the invention showing further forms of mounting assembly.

FIG. 16 shows another arrangement by which a cutter according to the present invention may be secured to the bit body. In this case, the generally cylindrical cutter 62 is formed with a central stepped aperture 63 through which passes a clamping screw 64 which engages a threaded hole in the bit blade 65. An enlarged head 66 of the screw 64 bears on the annular surface 67 between two parts of the stepped hole 63. The mounting part 68 of the cutter is received in a cylindrical socket 69 in the blade and may be clamped securely within the socket by tightening up the screw 64.

The arrangements of FIGS. 12–16 all allow the rotational orientation of each cutter to be adjusted, if required. This may allow rotational indexing of the cutters to compensate for cutter wear.

Figure 17:
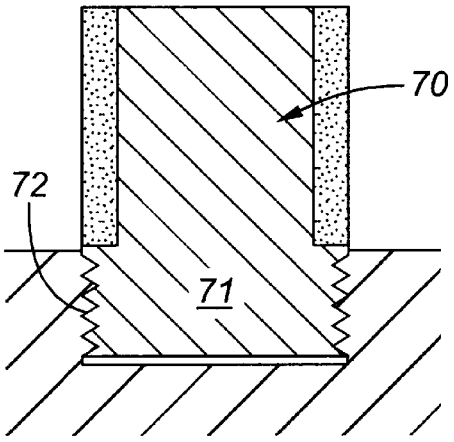

FIG. 17 shows an alternative arrangement where a cylindrical cutter 70 in accordance with the invention has a mounting part 71 which is externally screw-threaded and is received within a correspondingly screw-threaded socket 72 in the bit body.

Whereas the present invention has been described in particular relation to the drawings attached hereto, it should be understood that other and further modifications, apart from those shown or suggested herein, may be made within the scope and spirit of the present invention.

What is claimed is:

1. A preform element comprising a substrate having an outer peripheral surface, an end surface and a cylindrical mounting part, an exposed end face on the end surface, at least a portion of the peripheral surface of the substrate having bonded thereto an inner surface of a peripherally extending facing layer of superhard material, said superhard material extending circumferentially entirely about the outer peripheral surface between the exposed end face and the cylindrical mounting part, said portion of the peripheral surface of the substrate and the inner surface of the peripheral facing layer being provided with inter-engaging formations whereby the peripheral facing layer is keyed to the substrate wherein said peripheral superhard facing layer extends to a peripheral junction between said portion of the peripheral surface of the substrate and said end surface of the substrate and the superhard facing layer has an integral end portion which extends at least partly across said end surface of the substrate.

2. The preform element according to claim 1, wherein the inter-engaging formations include inwardly extending projections on one of the inner surface of the facing layer and the portion of the outer surface of the substrate, which projections engage within corresponding recesses in the other of the inner surface of the facing layer and the portion of the outer surface of the substrate.

3. The preform element according to claim 2, wherein said projections and recesses comprise inter-engaging elongate ribs and grooves.

4. The preform element according to claim 3, wherein said ribs and grooves extend circumferentially of the element.

5. The preform element according to claim 3, wherein said ribs and grooves extend generally axially of the element.

6. The preform element according to claim 3, wherein said ribs and grooves extend in an orientation inclined to the axis of the element.

7. The preform element according to claim 3, wherein said ribs and grooves are generally parallel.

8. The preform element according to claim 1, wherein the end surface of the substrate and the end portion of the facing layer are also provided with inter-engaging formations to provide a key between them.

9. The preform element according to claim 1, wherein elements of superhard material are embedded in the exposed end face of the substrate.

10. The preform element according to claim 9, wherein said elements of superhard material comprise natural diamonds.

11. The preform element according to claim 9, wherein said elements of superhard material comprise bodies of synthetic polycrystalline diamond.

* * * * *